US007383620B2

(12) United States Patent
Smith

(10) Patent No.: US 7,383,620 B2
(45) Date of Patent: Jun. 10, 2008

(54) BUCKLE SUPPORT ASSEMBLY

(75) Inventor: Paul Smith, Davison, MI (US)

(73) Assignee: Takata Seat Belts, Inc., Auburn Hills, MI (US)

( * ) Notice: Subject to any disclaimer, the term of this patent is extended or adjusted under 35 U.S.C. 154(b) by 0 days.

(21) Appl. No.: 11/127,056

(22) Filed: May 11, 2005

(65) Prior Publication Data

US 2006/0254033 A1 Nov. 16, 2006

(51) Int. Cl.
*B60R 21/00* (2006.01)

(52) U.S. Cl. ..... 24/633; 24/265 EC; 24/629; 24/650; 280/801.1; 280/801.2; 280/808; 280/803; 297/468; 297/482

(58) Field of Classification Search ..... 24/633, 24/265 BC, 629, 650; 297/468, 482, 385; 280/801.1, 808, 801.2, 803
See application file for complete search history.

(56) References Cited

U.S. PATENT DOCUMENTS 3,318,634 A 5/1967 Nicholas
4,119,344 A * 10/1978 Kondo ..... 297/471
4,611,854 A * 9/1986 Pfeiffer ..... 297/468
4,645,231 A 2/1987 Takada
4,928,992 A 5/1990 Qvint et al.
4,966,393 A * 10/1990 Tokugawa ..... 280/801.1
5,098,162 A * 3/1992 Forget et al. ..... 297/482
5,573,306 A * 11/1996 Galloway et al. ..... 297/482
5,860,706 A * 1/1999 Fausel ..... 297/481
6,126,241 A 10/2000 Wier
6,769,157 B1 * 8/2004 Meal ..... 24/633

FOREIGN PATENT DOCUMENTS

EP 0 327 968 A1 8/1989
JP 9-095205 4/1997
JP 10-278739 10/1998
JP 2003-169703 6/2003

* cited by examiner

*Primary Examiner*—Robert J. Sandy
*Assistant Examiner*—Marcus Menezes
(74) *Attorney, Agent, or Firm*—Fitch, Even, Tsbin & Flannery

(57) ABSTRACT

A buckle support assembly is provided including an anchor member and a buckle with a support member extending therebetween. A sleeve member is supported in position to extend between the anchor member and buckle and about the support member via interfering portions of the anchor member and sleeve member. Preferably, the interfering portions include small tabs of the anchor member and internal ribs of the sleeve member.

13 Claims, 6 Drawing Sheets

BUCKLE SUPPORT ASSEMBLY

FIELD OF THE INVENTION

The invention relates to a buckle support assembly and, more particularly, to an assembly having an anchor member and a support member extending upwardly to a buckle with a sleeve extending about the support member.

BACKGROUND OF THE INVENTION

Buckle support assemblies anchor the buckle adjacent a vehicle seat for being supported in an elevated position at the side of the seat. Support assemblies can also extend between the backrest and cushion to support the buckle above the cushion. These buckle support assemblies can utilize a support member of a metallic material such as a steel strap or the like so that the buckle is rigidly held in place. However, it has been observed that such a steel support member can make the buckle an undesirable rigid obstacle to comfortable seating on the vehicle seat if a passenger comes into contact therewith. Accordingly, it has been proposed to use seat belt webbing material for the support member instead of steel material. In either case, at times it has been found that it is desirable to have a cover or sleeve member that conceals the support member. The sleeve member extends from the lower anchor member secured to the vehicle body up toward the buckle at its elevated position.

Typically, in these buckle support assemblies using webbing material support members, there is a lower extension portion on the sleeve that is fastened to the webbing material to keep the sleeve in position about the support member. The extension portion can be of thin plastic material so that a fastener member such as a staple or plastic push pin can be driven through the extension and the belt webbing material for fixing the support member thereto. Alternatively, the lower anchor plate has a anchor bolt opening, and the extension can project into the area adjacent to the opening so that the head of the anchor bolt clamps the extension to the anchor plate when the anchor plate is bolted to the vehicle body.

Both the use of distinct fasteners and the clamping or trapping of the plastic material of the sleeve described above are undesirable. Mechanical fasteners such as staples and pins can become dislodged during use. Further, the use of mechanical fasteners also adds cost and time to the assembly process. Trapping the plastic material of the sleeve between the bolt and anchorage of the anchor plate can reduce the strength of the anchorage of the anchor plate to the vehicle body. An installer may not be able to tighten the bolt sufficiently or, if using a torque wrench, may read an artificially high level of torque as they are fastening the bolt to the vehicle body due to the trapped plastic material.

Accordingly, there is a need for an improved buckle support assembly in terms of how the sleeve member is retained in proper position relative to the support member. More particularly, a buckle support assembly is desirable that mounts the sleeve member without the need for fastening or clamping of the sleeve member.

SUMMARY OF THE INVENTION

In accordance with one form of the present invention, a buckle support assembly is provided that includes a anchor plate and a buckle with a support member that extends therebetween for supporting the buckle in an elevated position relative to the anchor plate. A sleeve member extends about the support member and between the anchor plate and the buckle. To keep the sleeve member in position about the support member, interfering portions of the sleeve member and the anchor plate are provided.

In one preferred form, the support member is of belt webbing material, and the interfering portions of the sleeve and anchor plate engage to keep the sleeve extending upwardly beyond the anchor plate and avoid the need for fastening or clamping of the sleeve member.

The interfering portions can include lower sleeve portions and intermediate anchor plate portions so that the anchor plate has an upper portion extending in the sleeve and the lower portion projecting downwardly from the sleeve.

In another form, the anchor plate includes a lower mounting portion secured to the vehicle body, and the sleeve is entirely spaced above the mounting portion by the interfering engagement between the sleeve and anchor plate interfering portions. In this manner, there is no portion of the sleeve that extends into the mounting area of the anchor plate to the vehicle body.

In one form, the sleeve has upper and lower ends and the sleeve interfering portions are configured to allow the anchor plate to be pulled through the sleeve from the upper end toward the lower end with the anchor plate interfering portions engaging the sleeve interfering portions as the anchor is pulled through the sleeve until the sleeve and anchor plate interfering portions are in clearance with each other.

In another form of the invention, there are interfering projections formed on the anchor plate and internally in the sleeve that cooperate to limit downward shifting of the sleeve relative to the anchor plate.

In one form, the anchor plate has spaced, generally parallel lateral edges and the anchor plate projections are tab projections extending laterally from the anchor plate edges.

In another form, the sleeve has an inner surface, and there is a gap between the sleeve projections and the sleeve inner surface to allow the anchor plate to be pushed through the sleeve for assembly.

The sleeve projections can be in the form of integral ribs that form a generally T-shaped cross-sectional configuration on either side of the sleeve.

In addition to the entire buckle support assembly, the invention also contemplates a specially configured anchor plate, and a specially configured sleeve for use in a buckle support assembly.

DETAILED DESCRIPTION OF THE PREFERRED EMBODIMENTS

Figure 1:
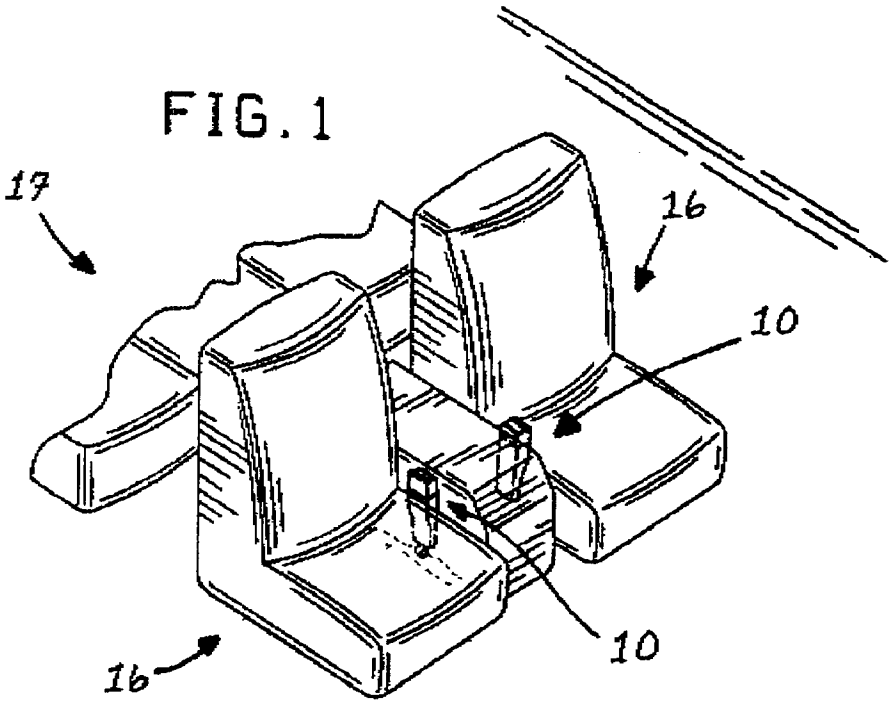
FIG. 1 is a perspective view of a pair of buckle support assemblies for positioning a buckle in an elevated position alongside respective vehicle seats.
Figure 2:
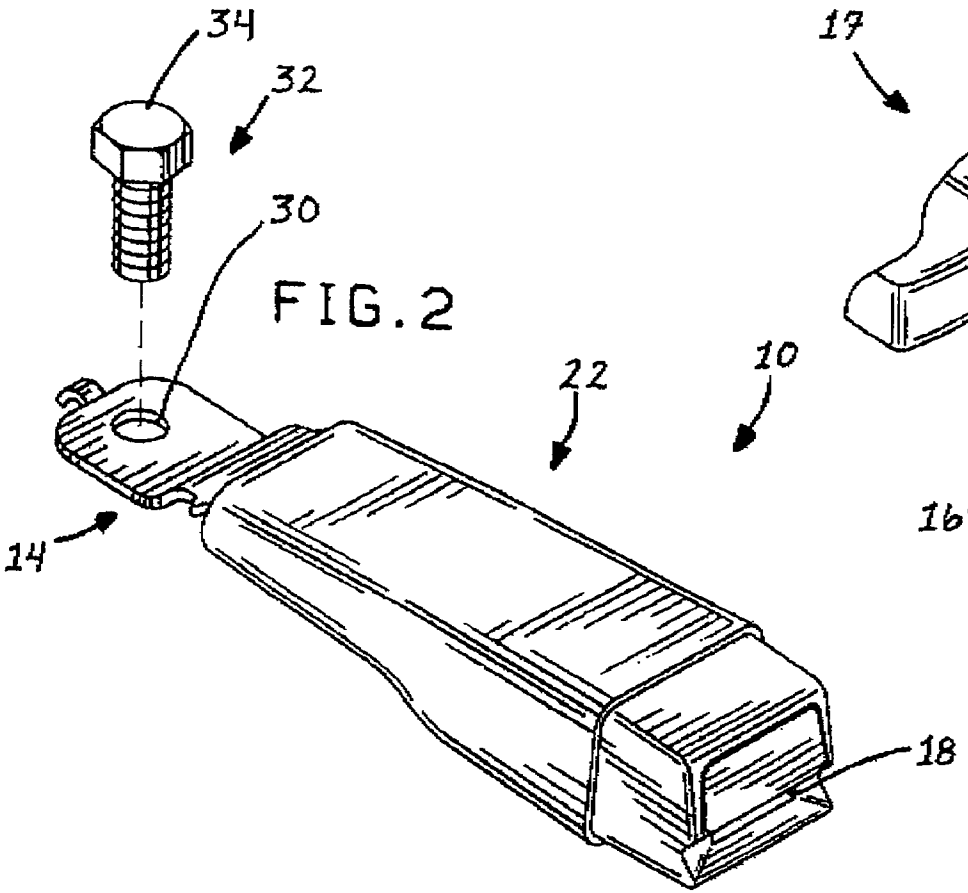
FIG. 2 is a perspective view of the buckle support assembly in accordance with the present invention showing a buckle sleeve having an anchor plate projecting out from the lower end of the sleeve and a buckle projecting out from the upper end of the sleeve.
Figure 3:
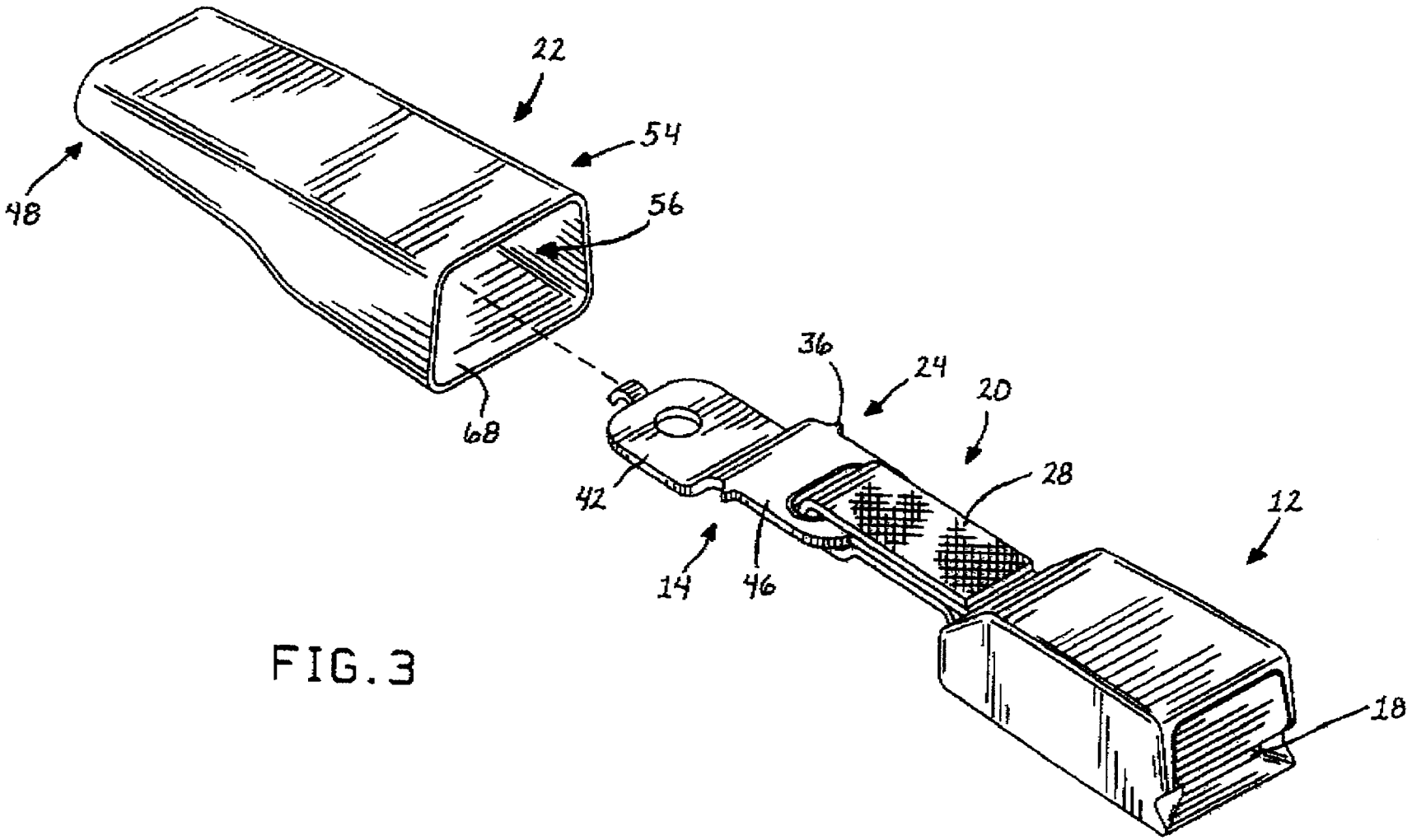
FIG. 3 is a perspective view of the buckle support assembly with the sleeve removed showing a support member of belt webbing material extending between the anchor plate and the buckle.
Figure 4:
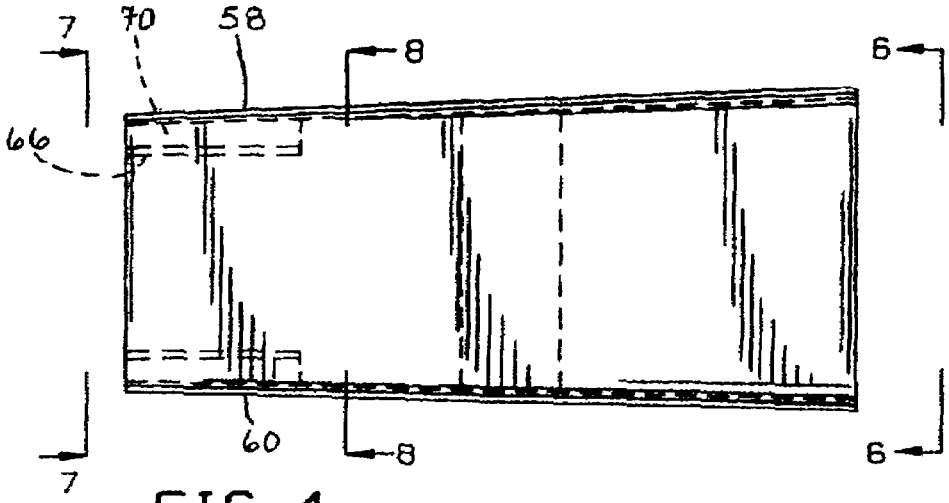
FIG. 4 is a plan, cross-sectional view of the sleeve member showing the position of internal ribs at the smaller end of the sleeve member.

In FIGS. 1-3, a buckle support assembly 10 is shown. The buckle support assembly 10 anchors a buckle 12 to a body or frame member of a vehicle with an anchor plate 14. The buckle support assembly 10 is adapted to support the buckle 12 in an elevated position such as alongside a vehicle seat 16 secured to a lower, side frame member of the vehicle seat frame, as shown in FIG. 1. Alternative locations are also known such as with rear bench seats 17 where the support assembly 10 can extend between the back rest and cushion to support the buckle 12 at an elevated position relative to the cushion.

As illustrated, the buckle support assembly 10 acts to keep the buckle 12 in its elevated position so that a slot opening 18 generally remains in an upwardly facing orientation. In this manner, the seat occupant can readily insert a tongue plate on a seat belt (not shown) into the slot opening 18 for securing the seat belt about themselves. Typically, the arrangement of the seat belt system will include the buckle support assemblies 10 on an inboard side of the seats 16 with the tongue plate slidingly supported on the seat belt having both upper and lower anchors on the outboard side of the seat. This provides a common three-point anchoring arrangement for the seat belt system, although it will be understood that the buckle support assembly 10 can be used with other seat belt systems and anchoring arrangements therefor.

The buckle support assembly 10 includes a support member 20 that extends between the lower anchor plate 14 and the upper buckle 12, and a single or unitary sleeve member 22 that is configured and positioned to extend about the support member 20 and to extend between the anchor plate 14 and the buckle 12, as can be seen in FIG. 2. For this purpose, the anchor plate 14 and sleeve member 22 include interfering portions 24 and 26, respectively, that cooperate to keep the sleeve member 22 in proper position extending about the support member 20. By way of the anchor and sleeve interfering portions 24 and 26, the buckle support assembly 10 does away with the need for separate fastener or clamp members to secure the sleeve member 12 in position. In particular, with support members that include belt webbing material 28 such as the illustrated support member 20, the interfering portions 24 and 26 avoid the need to have staple or pin fasteners or the like that penetrate both the preferred plastic material of the sleeve member 22 and the belt webbing material of the support member 20 for staking the two together. It is also known to have the plastic material of the sleeve extended into the area about the bolt opening 30 of the anchor plate 14. In this manner, when the anchor plate 14 is secured to the vehicle body with anchor bolt 32, the enlarged head 34 of the bolt 32 clamps the sleeve plastic material between it and the anchor plate 14 for securing the sleeve member 22 in position. The present anchor and sleeve interfering portions 24 and 26 avoid the need to have the sleeve member 22 configured to extend into the mounting area of the anchor plate 14. It should be noted that the support member 20 can be of other materials and constructions than that described herein.

The interfering anchor and sleeve portions 24 and 26 can be in the form of projections and, more particularly, in the form of tab projections 36 of the anchor plate 14 and rib projections 38 of the sleeve member 22. The sleeve member 22 will extend upwardly from the anchor plate projections 36 once the sleeve member 22 is assembled in the buckle support assembly 10. More specifically, the anchor plate 14 has a plate body 40 of metallic material including a flat, lower portion 42 in which the bolt opening 30 is formed. Preferably the anchor plate body 40 has a jog or transverse portion 44 between the lower mounting portion 42 and a flat, upper belt connecting portion 46. This is beneficial to provide clearance for installation of the anchor plate 14. As can be seen best in FIG. 3, preferably the tabs 36 are formed integrally with the plate body 40 at a position along the length thereof that is above the lower portion 42 such as along the upper portion 46 adjacent the angled, transverse portion 44. Further, the sleeve ribs 38 preferably extend all the way down to the lower end 48 of the sleeve. In this manner, the tab projections 36 engaged with the interfering rib projections 38 will hold the sleeve member 22 to extend upwardly toward the buckle 12. This interfering engagement limits downward shifting of the sleeve member 22 relative to the anchor plate 14. With the preferred arrangement of the projections 36 and 38 described above, the upper portion 46 of the plate body 40 extends for the majority of its length in the sleeve member 22 while the lower mounting portion 42 and transverse portion 44 project downwardly therefrom out from the sleeve member 22 with the anchor plate projections 36 substantially external to the sleeve member 22 at the sleeve lower end 48. Accordingly, when assembled, the sleeve member 22 is positioned above the plate lower mounting portion 42 as there is no need to clamp the sleeve material between the anchor bolt 32 and anchor plate 14.

The illustrated anchor plate 14 preferably has a narrow width construction with substantially parallel sides or edges 50 and 52 extending lengthwise along the plate body 40 and from which the tabs 36 extend laterally. By way of example and not limitation, the width of the anchor plate body 40 can be approximately 35 mm between the lateral sides 50 and 52 thereof. The small tabs 36 are aligned and spaced laterally across the width of the plate body 40 from each other. The use of small, laterally extending tabs 36 formed integrally with the plate body 40 advantageously keeps the size and, in particular, the width of the plate body 40 to a minimum for providing material cost advantages.

The sleeve member 22 can have a generally rectangular cross-sectional configuration that varies along the length thereof from the lower end 48 to its upper end 54. The upper end 54 preferably is enlarged relative to the small lower end 48 for receiving the buckle 12 therein. More particularly, the sleeve member 32 defines an internal space 56 in which both portions of the buckle 12 and anchor member 14 are received once assembled. With the rectangular configuration, the sleeve member 22 includes laterally spaced side wall portions 58 and 60 and larger, spaced wall portions 62 and 64 that interconnect the side wall portions 58 and 60. The ribs 38 are integrally formed with the side wall portions 58 and 60 so to project inwardly into the internal space 56.

Figure 10:
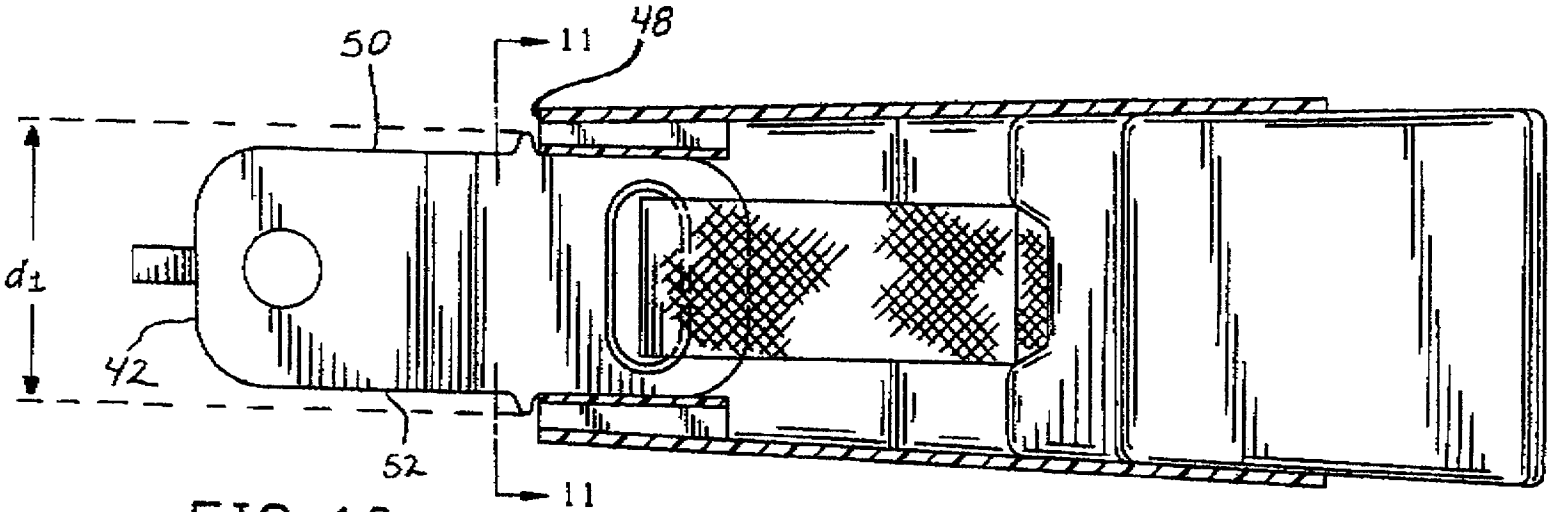
FIG. 10 is a plan view, partially in section of the assembled buckle support assembly showing interfering tab projections of the anchor plate at the lower end of the sleeve member.
Figure 11:
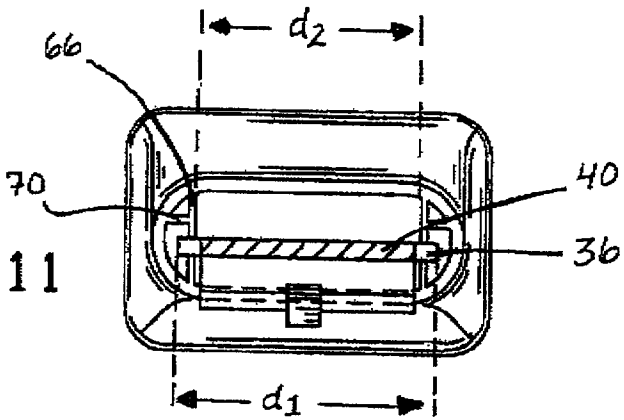
FIG. 11 is a cross-sectional view taken along line 11-11 of FIG. 10 showing the anchor plate projections in interference with the long portions of the sleeve interfering ribs.

As shown best in FIG. 11, the tab projections 36 are spaced laterally from each other by a distance $d_1$, and the rib projections 38 are spaced laterally from each other by a distance $d_2$ that is less than $d_1$By way of example and not limitation, the distances $d_1$ and $d_2$ can be approximately 41 mm and 35 mm, respectively. Accordingly, each tab 36 projects laterally from its corresponding side by approximately 3 mm. In this manner, once the sleeve member 22 is in assembled position relative to the buckle support assembly 10, the tabs 36 are in interfering engagement with the projections 38 so as to support the sleeve member 22 to extend upwardly away from the anchor plate 14 toward the buckle 12. As can be seen in FIG. 10, the distance $d_1$ is larger than the width of the anchor plate body 40 between the edges 50 and 52 thereof. On the other hand, the edges 50 and 52 are spaced at a lateral distance from each other that is approximately the same or less than the distance, $d_2$, across the sleeve rib projections 38 for assembly purposes.

As mentioned, the tabs 36 and ribs 38 have a sufficiently strong interfering engagement with each other such that with normal use in a vehicle, the sleeve member 12 is supported against downward shifting relative to the anchor plate 14. On the other hand, the ribs 38 are preferably configured so that with sufficient pull force on the anchor plate 14, i.e. a pull force significantly greater than normal downward forces that the sleeve typically may be expected to encounter during seat belt use, the tab projections 36 can overcome the interference with the ribs 38 for assembly purposes.

Turning to more of the details, the sleeve ribs 38 include an interfering rib 66 on either side of the sleeve member 22, as can be seen in FIGS. 4-8. The interfering ribs 66 each extend between the wall portions 62 and 64 and are generally spaced inwardly from the inner surface 68 of the sleeve member 22 along the side wall portions 58 and 60. The ribs 66 extend lengthwise along the sleeve member 22 in the internal space 56 thereof. The ribs 66 are laterally spaced by the distance $d_2$ from each other. The anchor plate 14 is oriented relative to the sleeve member 22 such that the generally parallel, flat body portions 42 and 46 extend orthogonal or perpendicular to the interfering ribs 66 extending between the sleeve wall portions 62 and 64.

To increase the resistance of the ribs 66 against deflection, support ribs 70 are also provided extending from the sleeve inner surface 68 at either side wall portion 58 and 60 to the adjacent interfering rib 66. The support ribs 70 can extend perpendicular to the interfering ribs 66 so as to be substantially parallel to the plate body portions 42 and 46. The ribs 66 and 70 cooperate to form a T-shaped cross-sectional configuration for the rib projections 38 on either side of the sleeve member 22 in the internal space 56 thereof. The support ribs 70 are preferably integrally connected to the interfering ribs 66 at a position spaced or offset from the midpoint thereof between the sleeve wall portions 62 and 64. As shown, the rib 70 is connected to the rib 66 at a position closer to the wall portion 62 than the wall portion 64 so that the ribs 66 have a short portion **66*a* and a long portion 66*b* thereof. Thus, the long portion 66*b* is provided with greater flexibility than the shorter rib portions 66*a* which is desirable for assembly purposes as described hereinbelow. It should be apparent that the exact construction of the support rib 70 can vary. For example, the support rib 70 can have a V-shaped configuration with the tip of the V-shaped rib connected to the rib 66 to form short and long portions 66*a* and 66*b*** thereof.

Figure 12:
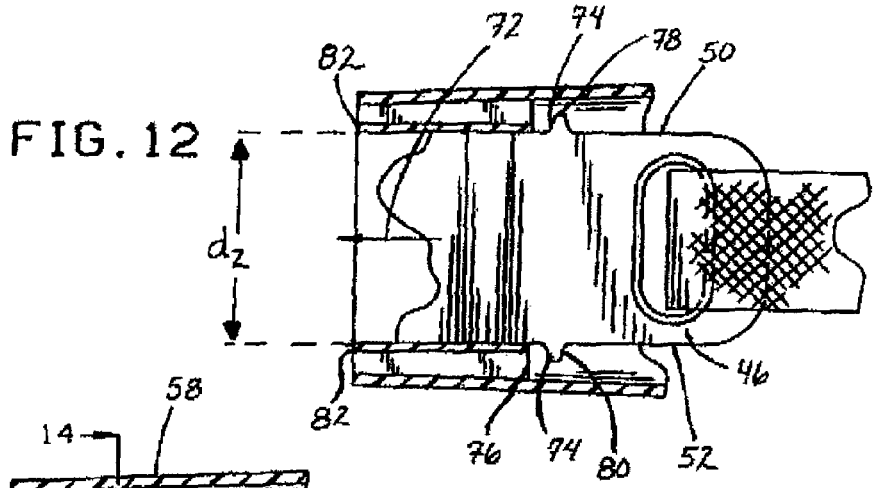
FIGS. 12-15 are partially sectioned views of the anchor plate being pulled through the sleeve from the upper end to the lower end and showing the engagement of the anchor plate and sleeve member interfering portions.

For assembly purposes, the buckle 12 and anchor plate 14 are interconnected by the support member 20 prior to having the sleeve member 22 assembled thereto. For assembly, the anchor plate 14 is pulled through the sleeve member 22 from the enlarged upper end 54 through the smaller lower end 48 as indicated by arrow 72 of FIG. 12. The tab projections 36 preferably have a cam surface 74 that extends obliquely to the parallel side edges 50 and 52 of the plate member 14. These cam surfaces 74 face the innermost ends 76 of the interfering ribs 66 and are ramped to extend generally away therefrom toward the outermost tips 78 of the tab projections 36. Thus, the distance $d_2$ is measured from the tip ends 78 of the tab projections 36. The trailing surface 80 of the tab projections 36 can also extend obliquely to the edges 50 and 52 so that the tab projections 36 have a triangular configuration. Alternatively, the surfaces 80 can extend perpendicular to the edges 50 and 52 since they are not intended to cam against the interfering ribs 66 as are the cam surfaces 74.

Figure 13:
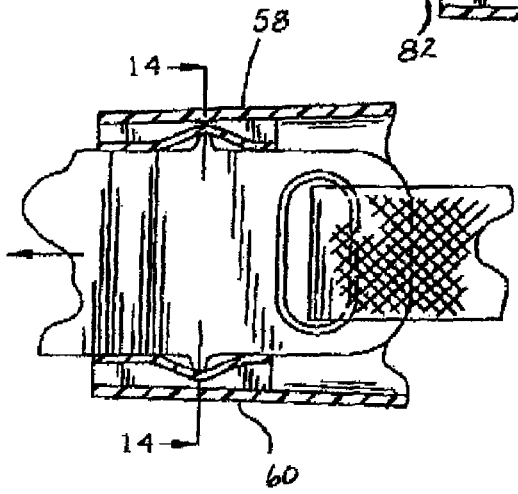
Figure 14:
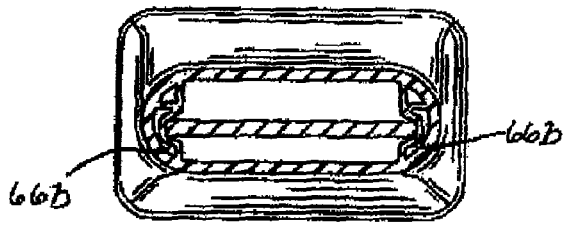
Figure 15:
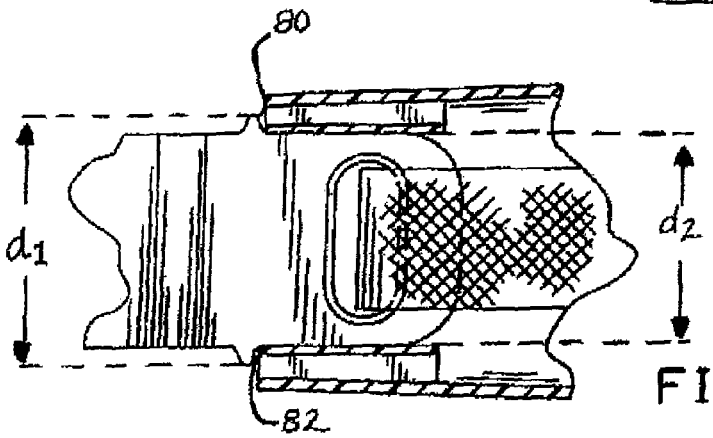

Referring more specifically to FIGS. 13 and 14, continuing to pull the anchor plate 14 in direction 72 causes the cam surfaces 74 to engage the rib ends 76 so that the tab projections 36 then cause the ribs 66 to deflect outwardly toward the respective side wall portions 58 and 60 of the sleeve member 22. As can be seen in FIG. 14, the anchor plate 14 is drawn through the sleeve space 56 such that the tab projections 36 are aligned with the more flexible, long portions **66*b* of the ribs 66. In this manner, the pull force necessary on the anchor plate 14 is somewhat reduced for ease of assembly purposes. In addition, it is also contemplated that the plastic material can be heated so that it is slightly more pliable for ease of assembly. As shown, the rib portion 66*b* deflect into the space or gap 82 between the ribs 66 and the sleeve inner surface 68 during the sleeve assembly operation. Once the tip ends 78 of the tab projections 36 clear the outer or lowermost ends 82 of the ribs 66, the ribs 66 will return to their original, undeflected orientation with the tab surfaces 80 in confronting engagement therewith, as shown in FIG. 15**.

Figure 5:
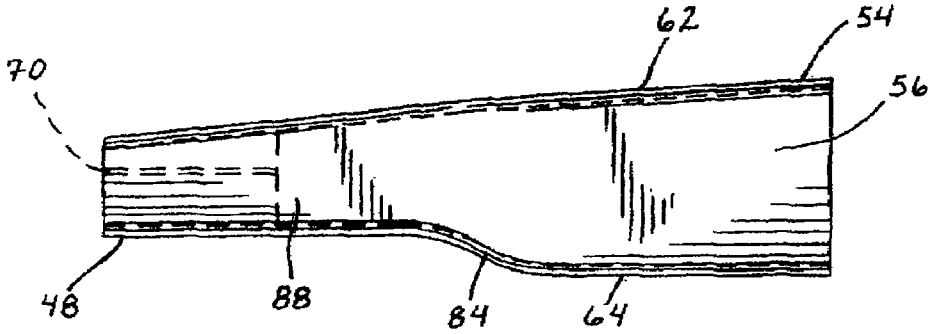
FIG. 5 is a side, cross-sectional view of the sleeve member showing the sizing of the small end and enlarged end thereof.
Figure 6:
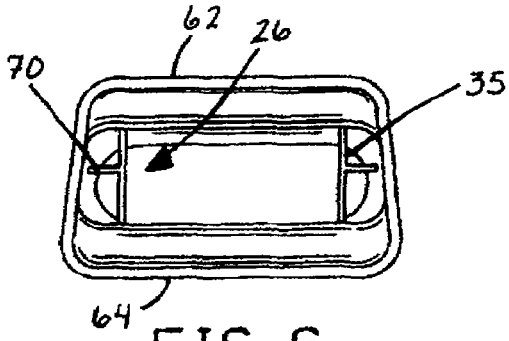
FIG. 6 is an end elevational view of the sleeve member taken along line 6-6 of FIG. 4 showing a T-shaped, cross-sectional configuration for the ribs on either side of the sleeve.
Figure 7:
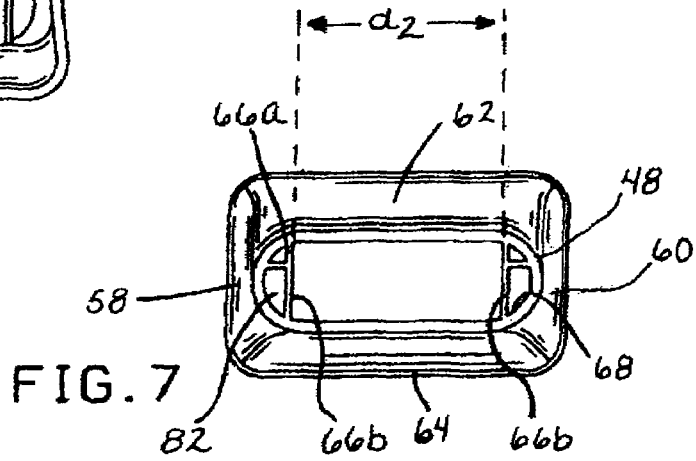
FIG. 7 is an end elevational view taken along line 7-7 of FIG. 4 showing a support rib intersecting an interfering rib so that there is a longer portion and a shorter portion of the interfering rib.
Figure 8:
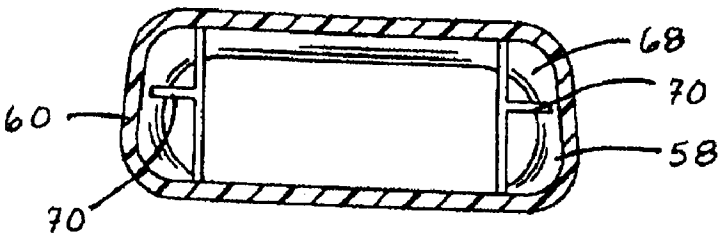
FIG. 8 is a cross-sectional view taken along line 8-8 of FIG. 4.
Figure 9:
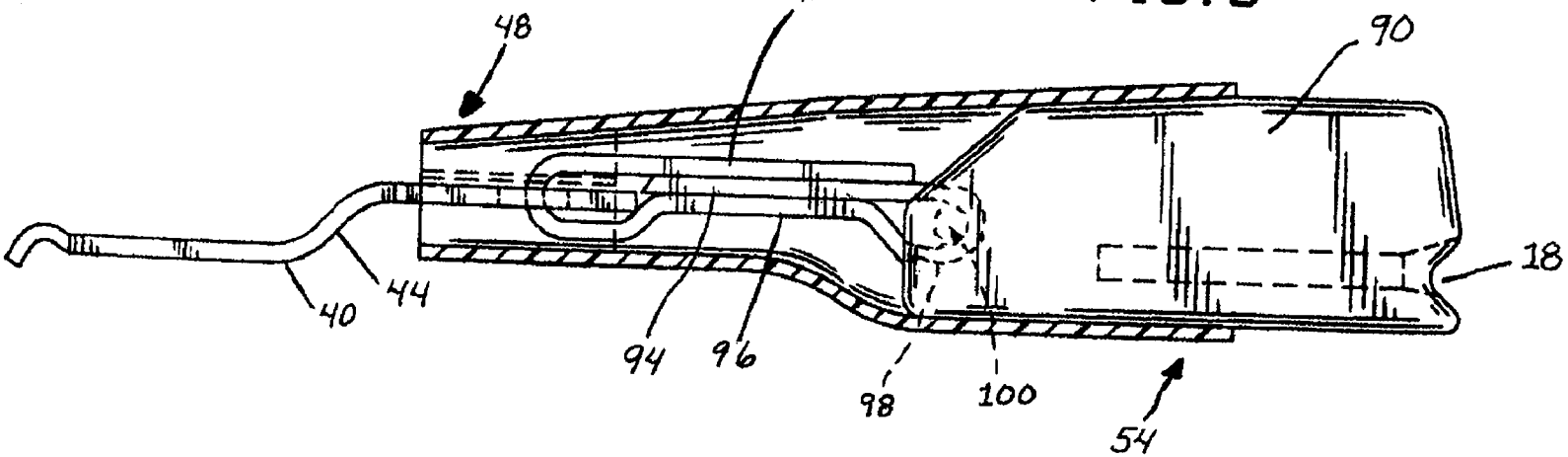
FIG. 9 is a side elevational view, partially in section of the buckle support assembly with the sleeve member assembled and having a friction fit with the housing of the buckle at the enlarged sleeve upper end.

As previously mentioned, the upper end 54 of the sleeve is enlarged relative to the lower end 48, as can be seen best in FIGS. 3, 5 and 9. As shown, the sleeve member 22 includes a section 84 of the wall portion 64 that tapers down from a larger compartment 86 of the sleeve internal space 56 adjacent the large end 54 down to a smaller compartment 88 of the sleeve internal space 56 adjacent the smaller sleeve end 48. The large compartment 86 is configured to substantially match the configuration of an outer housing 90 of the buckle 12 so that the sleeve inner surface 68 is tightly engaged therewith with the sleeve member 22 assembled, as shown in FIGS. 9 and 10.

The preferred friction fit provided by the sleeve member 22 with the buckle housing 90 also assists in keeping the buckle 12 properly oriented so that the slot opening 18 thereof remains facing upwardly for latching operations with a tongue plate, especially with the preferred support member 20 of belt webbing material 28. Such a belt webbing support member 22 is described in applicants' assignee's U.S. patent application Ser. No. 60/643,466, which is incorporated as if reproduced in its entirety herein.

Briefly, the belt webbing support member 20 is formed from belt webbing 28 that is folded along a longitudinal fold line to double the thickness of the belt webbing and reduce its width in half. Thereafter, the initial half-width, double thickness, stock member of belt webbing is folded about a pair of spaced lateral fold lines so that there are three stock portions 92, 94 and 96 that form the belt webbing support member 20 with a tri-fold configuration. In this manner, the belt webbing support member 20 has six layers of belt webbing material to provide it with sufficient stiffness for supporting the weight of the buckle 12 in its elevated position. Alternatively, the tri-fold configuration is only provided adjacent the buckle 12 with the remainder of the support member 20 having a bifold configuration.

The belt webbing support member 20 has an upper, loop end 98 that extends about a mounting post 100 of the buckle 12. Accordingly, the sleeve member 22 can retain the buckle 90 in position against pivoting relative to the support member 22 at the upper loop end 98 thereof, particularly where the buckle 12 is received by a friction fit in the large compartment 86 of the sleeve space 56, as previously described. However, even if the buckle 12 is received in the sleeve member space 56 without the friction fit, such as where the buckle 12 is mounted to a longer support member 20, as long as there is a lower portion of the buckle housing 90 extending into the compartment 86 of the sleeve space 56, the sleeve, and particularly wall portions 62 and 64 thereof will act to restrict pivoting of the buckle 12. In addition, while it is anticipated that the double-thickness, tri-fold belt webbing support member 20 will provide the buckle support assembly 10 with a desirable level of resistance against transverse bending, the sleeve member 22 can also provide assistance in this regard. Finally, while it is anticipated that the belt webbing support member 20 will be of sufficient stiffness to support the buckle 12 as mentioned above, the sleeve member 22 can provide a secondary supporting function for keeping the buckle 12 at its elevated position.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. A buckle support assembly for a vehicle, the buckle support assembly comprising:

an anchor plate having a lower mounting portion configured for being secured to a vehicle body and an upper belt connecting portion;

a buckle for receiving a tongue plate on a seat belt;

a support member of belt webbing material extending between the upper belt connecting portion of the anchor plate and the buckle to position the buckle at an elevated position for receiving the seat belt tongue plate;

a sleeve member extending about the support member and between the anchor plate and the buckle; and interfering portions of the sleeve and anchor plate that are positioned to engage each other to keep the sleeve extending upwardly beyond the upper portion of the anchor plate therein and avoid the need for fastening or clamping of the sleeve member with the anchor plate having a one-piece construction so that the upper and lower anchor plate portions are of a single piece and so that the lower portion projects down from the upper portion in a non-pivotable, fixed relation thereto and out from the sleeve member, and wherein the interfering portions comprise integral ribs in the sleeve and small, integral tab projections on the anchor plate.

2. The buckle support assembly of claim 1 wherein the interfering portions comprise lower sleeve portions and intermediate anchor plate portions.

3. The buckle support assembly of claim 1 wherein the interfering portions of the sleeve extend generally orthogonal to the anchor plate.

4. The buckle support assembly of claim 1 wherein the sleeve has upper and lower ends and the sleeve interfering portions are configured to allow the anchor plate to be pulled through the sleeve from the upper end toward the lower end with the anchor plate interfering portions engaging the sleeve interfering portions as the anchor plate is pulled through the sleeve until the sleeve and anchor plate interfering portions are in clearance with each other.

5. The buckle support assembly of claim 1 wherein the buckle has a housing and the sleeve has an enlarged upper end sized to have a friction fit on the buckle housing.

6. The buckle support assembly of claim 1 wherein the belt webbing support member comprises multiple layers of belt webbing material.

7. The buckle support assembly of claim 1 wherein the belt webbing support member includes an upper loop of belt webbing material to which the buckle is mounted, the sleeve includes an upper portion extending about the buckle, and the buckle has an opening for receiving the tongue plate with the sleeve upper portion supporting the buckle against pivoting about the support member loop to keep the buckle opening facing upwardly.

8. A buckle support assembly for a vehicle, the buckle support assembly comprising:

an anchor plate for being mounted to a vehicle body;

a buckle;

a support member extending between the anchor plate and the buckle to support the buckle at an elevated position in a vehicle;

a sleeve extending about the support member and between the anchor plate and the buckle with the sleeve having an upper end portion at which the buckle is disposed and a lower end portion at which the anchor plate is disposed; and interfering projections formed on the anchor plate and internally in the sleeve that cooperate to limit downward shifting of the sleeve relative to the anchor plate, the interfering projections including an inner thin rib of the sleeve spaced from an inner surface of the sleeve to form a gap therebetween and a tab projection of an upper portion of the anchor plate having a cam surface that engages and deflects the thin rib into the gap toward the sleeve inner surface as the anchor plate is drawn through the sleeve from the upper end portion to the lower end portion thereof for assembly, the anchor plate having a one-piece construction so that the anchor plate and the tab projection are of a single piece with the anchor plate having a lower portion that extends out from the sleeve lower end portion in a non-pivotable, fixed relation to the anchor plate upper portion.

9. The buckle support assembly of claim 8, wherein the anchor plate has spaced, generally parallel lateral edges and the anchor plate tab projection comprises tab projections extending laterally from the anchor plate edges.

10. The buckle support assembly of claim 8, wherein the support member comprises belt webbing material.

11. A buckle support assembly for a vehicle, the buckle support assembly comprising:

an anchor plate for being mounted to a vehicle body;

a buckle;

a support member extending between the anchor plate to the buckle to support the buckle at an elevated position in a vehicle;

a sleeve extending about the support member and between the anchor plate and the buckle; and interfering projections formed on the anchor plate and internally in the sleeve that cooperate to limit downward shifting of the sleeve relative to the anchor plate, wherein the sleeve has an upper buckle end and a lower anchor end and the sleeve projections extends to the lower end so that the anchor plate projection engaged with the sleeve projection is substantially disposed externally of the sleeve.

12. The buckle support assembly of claim 11, wherein the sleeve has a longitudinal axis extending therethrough, and the sleeve projection comprises ribs that form a generally T-shape cross-sectional configuration on either side of the sleeve taken in a plane extending normal to the longitudinal axis.

13. The buckle support assembly of claim 11, wherein the sleeve has a unitary construction.

* * * * *

UNITED STATES PATENT AND TRADEMARK OFFICE

CERTIFICATE OF CORRECTION

PATENT NO. : 7,383,620 B2
APPLICATION NO. : 11/127056
DATED : June 10, 2008
INVENTOR(S) : Paul Smith It is certified that error appears in the above-identified patent and that said Letters Patent is hereby corrected as shown below:

Column 9, line 14, delete “projections” insert --projection-- therefor.

Signed and Sealed this

Twenty-third Day of September, 2008

JON W. DUDAS
*Director of the United States Patent and Trademark Office*